US005722596A

United States Patent [19]

Dome

[11] Patent Number: 5,722,596

[45] Date of Patent: Mar. 3, 1998

[54] MIST-EMITTING LOUNGE CHAIR

[76] Inventor: Gregory A. Dome, 7720-B El Camino Real, Carlsbad, Calif. 92009

[21] Appl. No.: 531,726

[22] Filed: Sep. 21, 1995

[51] Int. Cl.[6] ..... B05B 15/00

[52] U.S. Cl. ..... 239/289; 4/496; 4/541.3; 297/180.1; 297/180.15

[58] Field of Search ..... 239/279, 289; 4/492, 496, 541.1–541.5; 446/267; 297/180.1, 180.11, 180.13, 180.15, 180.14, 452.12, 452.14, 452.41, 452.46, 452.64, 900

[56] References Cited

U.S. PATENT DOCUMENTS

| | | | |
|---|---|---|---|
| 2,770,812 | 11/1956 | Whiteside | 4/145 |
| 3,461,878 | 8/1969 | Southard | 128/372 |
| 3,625,434 | 12/1971 | Kitover | 239/289 |
| 3,688,775 | 9/1972 | Raymann | 128/366 |
| 3,778,851 | 12/1973 | Howorth | 297/180.13 X |
| 3,969,776 | 7/1976 | Gildea | 4/172 |
| 3,997,927 | 12/1976 | Culligan | 5/344 |
| 4,109,960 | 8/1978 | Stinchfield | 297/258 |
| 4,141,585 | 2/1979 | Blackman | 297/180 |
| 4,468,822 | 9/1984 | McKay | 4/496 X |
| 4,548,357 | 10/1985 | Schmidt | 239/289 |
| 4,648,143 | 3/1987 | Breaux et al. | 5/417 |
| 4,765,542 | 8/1988 | Carlson | 239/289 |
| 4,854,502 | 8/1989 | Cox | 239/124 |
| 4,925,099 | 5/1990 | Owen | 239/289 |
| 4,961,535 | 10/1990 | Skibik | 239/289 |
| 4,986,781 | 1/1991 | Smith | 4/541.3 X |
| 5,000,384 | 3/1991 | Arnold | 239/128 |
| 5,004,296 | 4/1991 | Ziegenfuss, Jr. | 297/452.41 X |
| 5,101,809 | 4/1992 | Daffer et al. | 128/33 |
| 5,121,882 | 6/1992 | Skidmore | 239/269 |
| 5,156,339 | 10/1992 | Gibson et al. | 239/289 |
| 5,233,705 | 8/1993 | Coleman et al. | 4/496 |
| 5,322,342 | 6/1994 | Gange | 297/180 |
| 5,387,181 | 2/1995 | Olsen | 601/155 |
| 5,560,056 | 10/1996 | Tai | 297/452.41 X |

OTHER PUBLICATIONS

Rotational Molding—The Introductory Guide to Designing Rotationally Molded Plastic Parts, PDM Molding, Inc. Littleton, Colorado 1994.

Suntamer "The Ultimate in Sunbathing" Suntamer Marketing Associates, Inc.

*Primary Examiner*—Andres Kashnikow
*Assistant Examiner*—Steven J. Ganey
*Attorney, Agent, or Firm*—Henri J.A. Charmasson; John D. Buchaca

[57] ABSTRACT

An outdoor lounge chair particularly adapted for sunbathing comprises a uni-body frame defining a planar body supporting structure bent into a dogleg configuration to comfortably support a person in a reclining position. The support structure is made from two plies of sheet plastic joined around a periphery. A network of copper pipes sandwiched between the two plies of sheet plastic has an inlet port with a coupling for attachment to a water hose. A plurality of outlet ports are fitted with spray nozzles mounted on the peripheral edge of the lounge chair; whereby the user's body can be cooled by the mist emitting from the spray nozzles.

20 Claims, 4 Drawing Sheets

MIST-EMITTING LOUNGE CHAIR

FIELD OF THE INVENTION

This invention relates to outdoor furniture, and more specifically to sun-bathing lounge chairs.

BACKGROUND OF THE INVENTION

There have been many attempts to combine water-misting devices with pool-side and patio lounge chairs and cots. The avowed purpose of the combination is to generate a cooling mist around the user's body while exposing the body to the tanning rays of the sun.

The obvious approach to the implementation of such a combination is to start with a lounge chair having a tubular frame, and use sections of the frame to act as water conduits. A typical and early example of such an approach is disclosed in U.S. Pat. No. 2,770,812 Whiteside, where the rectangular, tubular frame of a cot is connected to a source of pressurized water through a water hose. Small orifices drilled along the length of the tubular frame act as spray nozzles to create a fine mist around the body-supporting portion of the cot. The same basic technique is applied in connection with various models of lounge chairs as disclosed, among others, in U.S. Pat. Nos. 3,625,434 Kitover, and 5,156,339 Gibson et al. This prior art technique is fraught with many disadvantages. In the first place, the tubular frames of most outdoor lounge chairs are not intended to carry water, and most often do not provide open connections between sections of the frame. For instance, right-angle and T-joints may be implemented with connecting hardware having no internal pass-through channels. Secondly, the tubular frame may be drilled at various points to accommodate hooks, and other types of fasteners for the body supporting web or netting. These holes constitute unwanted or unnecessary leakage points. Moreover, the tubular elements or the hardware components attached to or passing through them may offer little resistance to corrosion. Finally, elements of the frame may be joined by hinges and other types of articulation which do not provide a continuous fluid channel therethrough.

The solution to some of those problems have been to use sections of a flexible hose for hinges as disclosed in U.S. Pat. No. 3,625,434 Kitover or complex and expensive pivoting mechanisms such as those disclosed in U.S. Pat. No. 5,156,339 Gibson et al. and featured in the SUNTAMER brand of sun-bathing lounge chairs distributed by Suntamer Marketing Associates, Inc. of Englewood, Tenn.

Another way to palliate the above-described problems is to attach to the tubular frame of the lounge chair, a separate fluid-carrying network as disclosed in U.S. Pat. No. 4,548,357 Schmidt. This last approach is not only expensive and cumbersome, but results in very unsightly devices. The various water-carrying elements protruding around the chair frame constitute safety hazards.

Accordingly, there is a need to take an innovative approach to the design of mist-generating sunbathing lounge chairs that will yield an esthetically attractive article free of the many disadvantages that have plagued the devices of the prior art.

SUMMARY OF THE INVENTION

The principal and secondary objects of this invention are to provide a totally new type of mist-generating sunbathing lounge chair that is inexpensive to manufacture, is corrosion-free, avoids complex moving parts, and can be shaped into a stylish form.

These and other objects are achieved by forming a lounge chair carefully contoured to comfortably support a reclining body by a rotational molding process that creates a hollow body, and installing a network of fluid-carrying conduits within the hollow body with a plurality of mist-generating nozzles protruding through the skin of the hollow body at convenient spots around the periphery of the lounge chair.

DESCRIPTION OF THE PREFERRED EMBODIMENT OF THE INVENTION

Figure 1:
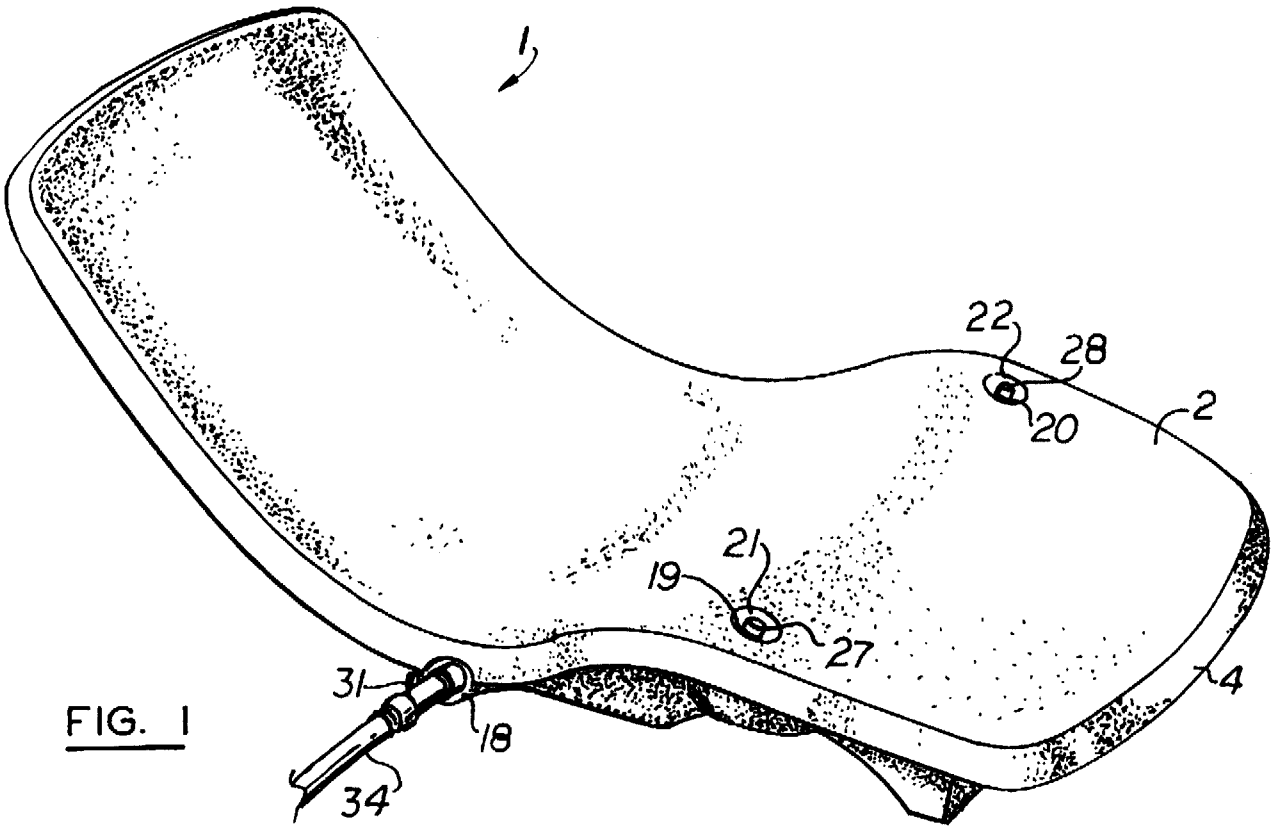
FIG. 1 is a front, top and right-side perspective view of the mist-emitting lounge chair according to the invention.
Figure 2:
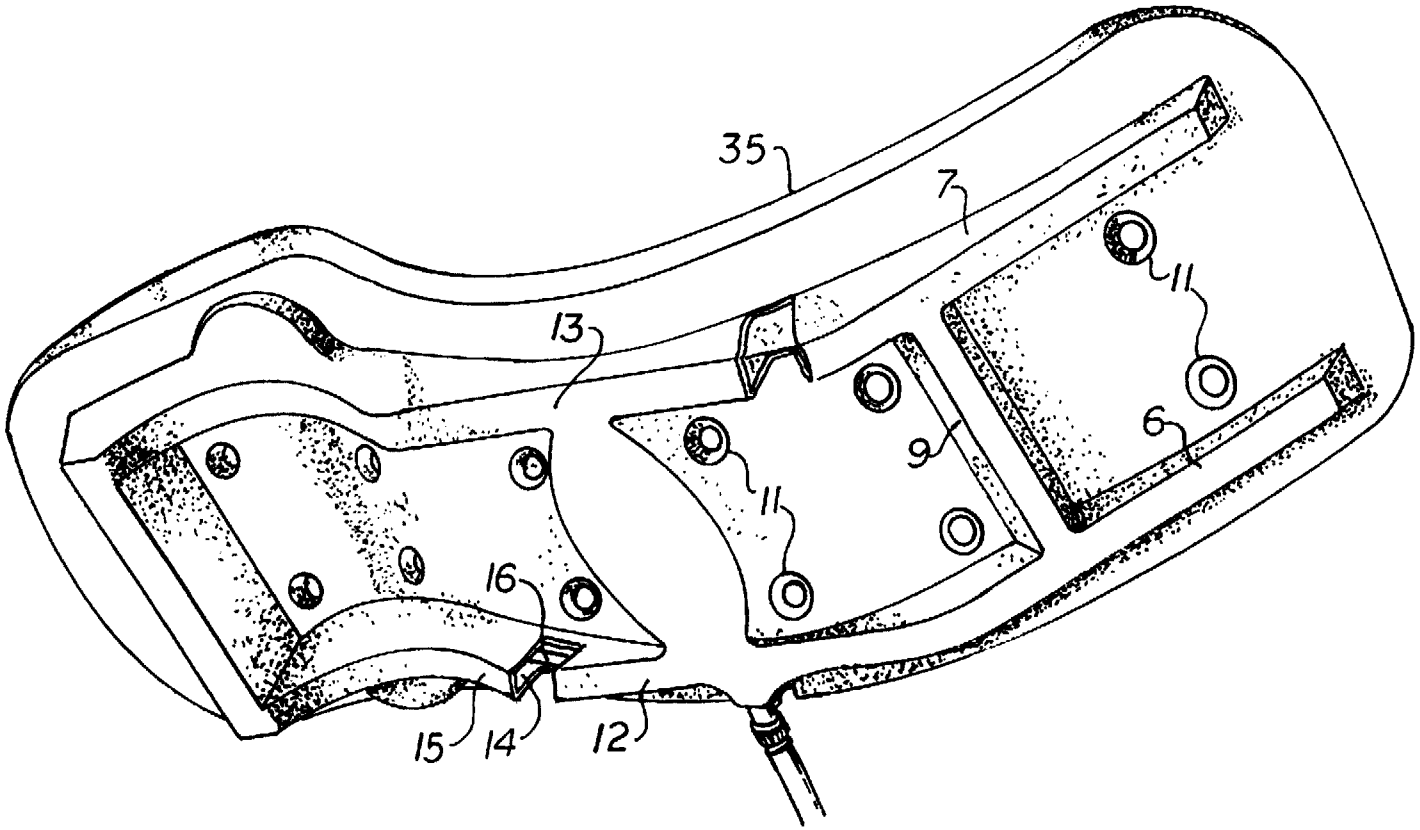
FIG. 2 is a bottom, back and left-side perspective view thereof.
Figure 3:
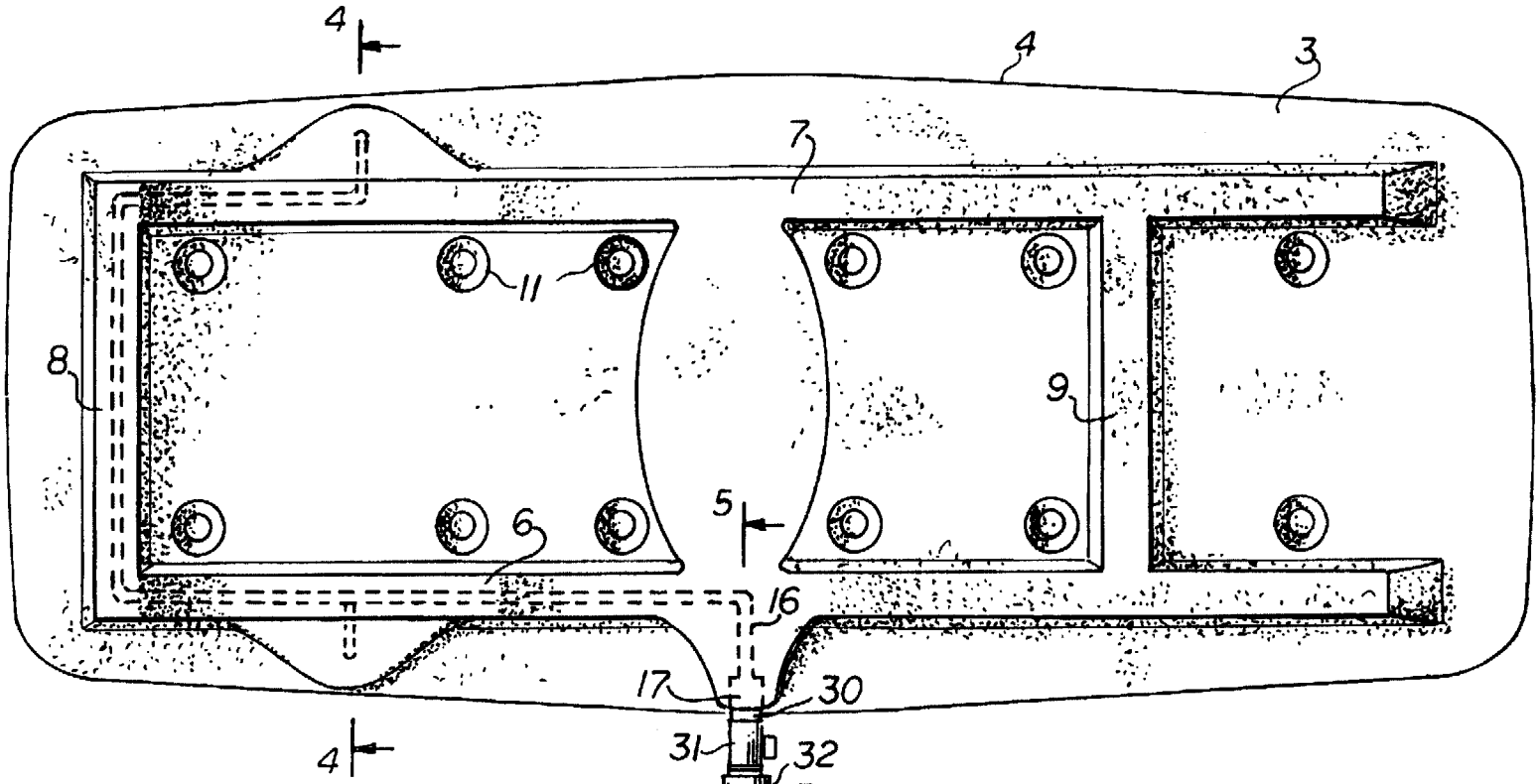
FIG. 3 is a bottom plan view thereof.
Figure 4:
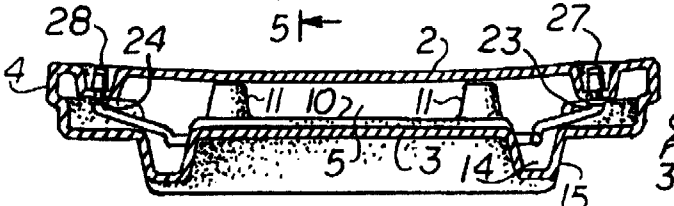
FIG. 4 is a cross-sectional view taken along line 4—4 of FIG. 3.
Figure 5:
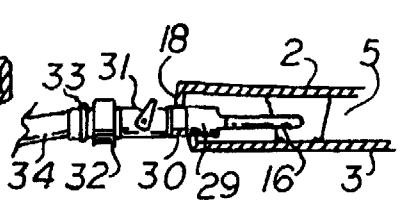
FIG. 5 is a partial cross-sectional view taken along line 5—5 of FIG. 3.
Figure 6:
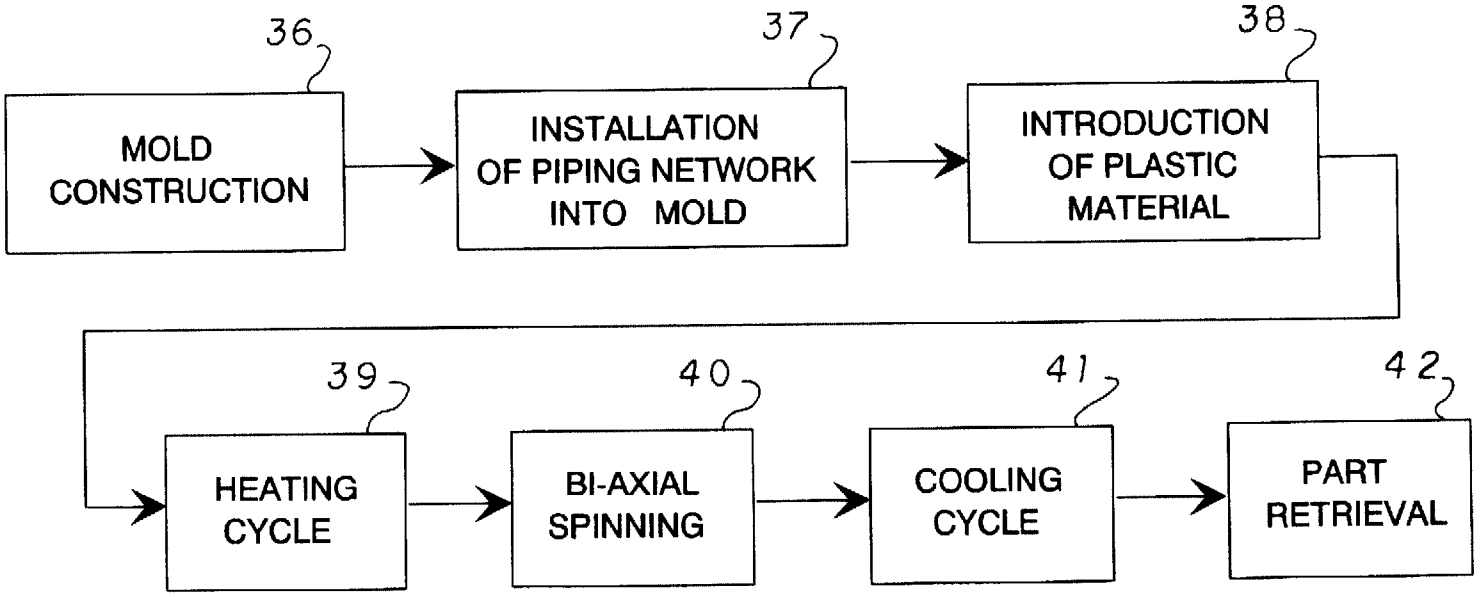
FIG. 6 is a block diagram of the rotational molding process.

Referring now to the drawing, there is shown a lounge chair 1 of a uni-body type of construction made by rotational molding process out of a thermo-plastic material, preferably a linear low density polyethylene. The structure comprises a top ply 2 and a bottom ply 3 of sheet plastic joined around their periphery 4 and defining therebetween a shallow chamber 5. The internal and external surface of the top ply 2 are substantially smooth. The bottom ply 3 is provided for strength with various infoldments including two parallel longitudinal ribs 6 and 7 intercepted by two transversal ribs 8 and 9. The ribs define connecting furrows in the internal surface 10 of the bottom ply, and corresponding ridges in the external surface of the bottom ply. The top ply 2 is further supported by pairs of so-called "kiss-off" cups 11 raising from the internal surface of the bottom ply 3 to contact the internal surface of the top ply 2. The median sections 12 and 13 of the longitudinal ribs 6 and 7 and the most forward transversal rib 8 have their undersurfaces in the same plane and are designed to support the lounge chair over a ground surface. The structure is bent in a dogleg-shape along its longitudinal axis to form a comfortable body-supporting surface for a person in a reclined position. The ribs 6–9 define furrows 14 into the internal surface of the bottom ply and corresponding protruding ridges 15 on the external surface of the bottom ply. A piping network 16 preferably made of 6.5 millimeters (¼ inch) copper ducts is nested within a portion of the furrows 14. The piping network has an inlet port 17 in the right wall 18 of an enlarged median section 12 of the right longitudinal rib 6, and two outlet ports 19 and 20 nested in wells 21 and 22 in opposite marginal, median portions of the top surface. The wells are formed by circular depressions in the external surface of the top ply. Terminal sections 23 and 24 of the piping network pass through holes in the bottom of the wells 21 and 22 and connect with spray nozzles 27 and 28 with in the wells. The top of the nozzles are substantially flush with the upper surface of the top ply leaving no protrusion that could snag clothing or cause discomfort or injury to the person laying thereupon.

The inlet port 17 comprises a pipe gauge expander 29 protruding through an aperture in the right wall 18 of the rib 6. The expander is connected internally to the piping network 16. Externally it is connected to a swiveling coupler 30 to a hand-operable-type valve 31 leading to a threaded female coupling 32 designed to mate with the male coupling 33 at the end of a garden hose 34.

It should be understood that in the absense of a utility source of pressurized water, the inlet port could be connected to the output of a pressurized garden sprayer as disclosed in U.S. Pat. No. 5,000,384 Arnold, to a sump-pump at the bottom of a water reservoir or to any similar device.

The plastic shell 35 which constitutes the main structure of the lounge chair is preferably made by a rotational molding process. This type of molding process is well-known in the art and is particularly adapted to produce small or large parts and products of unusual shape where thin walls are required with increasing wall thickness on outside corners of parts for increased strength. Such a process is disclosed in Rotational Molding, The Introductory Guide to Designing Rotationally Molded Plastic Parts, a publication of PDM Molding, Inc. of Littleton, Colo., which publication is hereby incorporated in this disclosure by this reference. The rotational molding process comprises the step of forming a two-part mold 36 preferably out of aluminum. The inside surface of the mold corresponds to the external outline of the molded part. The piping network shaped to conveniently nest within the furrows 14 is placed into the mold 37 with the nozzle-mounting portions 23 and 24 and part of the expander 29 protruding outside the mold. A sufficient volume of a thermal-plastic preferably a linear, low density polyethylene is deposited 38 inside the mold. The mold is then closed and subjected to sufficient heat 39 to melt the thermal-plastic material. The mold is then rotated about two perpendicular axes 40 in order to centrifugally spread the melted thermal-plastic into a layer of substantially even thickness against the internal surface of the mold. The mold is then cooled 41 to a temperature and for a period sufficient to cure the thermal-plastic to hardness, the mold is then opened to retrieve 42 the final shell.

The heat applied to the mold should be sufficient to liquefy the thermal-plastic but not so high as to damage or deform the piping network.

The plastic shell structure 35 is shaped and dimensioned to fit within a shipping coontainer having external dimensions not exceeding 137 by 61 by 61 centimeters (54×24×14 inches). The total weight of the structure is kept under 8 kilograms (17.6 lbs). These limited dimensions and weight allow for convenient shipment through parcel post services.

It should be noted that the plastic shell structure, being hollow, has enough buoyancy to support the user while floating in a pool or other body of water.

While the preferred embodiments of the invention have been described, modifications can be made and other embodiments may be devised without departing from the spirit of the invention and the scope of the appended claims.

What is claimed is:

1. An outdoor lounge chair which comprises:

a structure having a peripheral edge and being shaped and dimensioned to support an adult person in a reclining position above a surface, said structure comprising an envelope made of a top ply and a bottom ply of sheet plastic joined along said peripheral edge and defining therebetween a shallow chamber;

a fluid channel within said chamber, said channel including an inlet port, and at least one outlet port;

said inlet and outlet ports protruding through holes in said envelope;

said outlet port being positioned proximal to said peripheral edge;

means for coupling said inlet port to a source of pressurized fluid; and at least one spray nozzle mounted on said outlet port.

2. The lounge chair of claim 1, wherein said fluid channel comprises a piping network made of a material having a higher melting point than the sheet plastic of said top and bottom plies.

3. The lounge chair of claim 2, wherein said structure is manufactured by a rotational molding process which comprises:

forming a two-part mold having internal surfaces defining the external surfaces of said chair;

installing said piping network into said two-part mold;

depositing into said mold a volume of thermal-plastic material;

closing said mold;

exposing said mold to a temperature high enough to melt the thermo-plastic material without affecting said piping network;

rotating said mold about two perpendicular axes at speeds and for periods sufficient to centrifugally spread said melted plastic to a substantially even thickness against said internal surface of the mold;

cooling said mold to a temperature and for a period sufficient to cure said material to a hardened state; and opening said mold to retrieve said structure.

4. The lounge chair of claim 2, wherein said inlet port comprises:

a swiveling connector;

a first coupling compatible with a mating second coupling associated with a conduit of pressurized fluid.

5. The lounge chair of claim 4, wherein said coupling is compatible with a garden hose threaded coupling.

6. The lounge chair of claim 2, wherein said structure is buoyant enough to support said adult person over a water surface.

7. The lounge chair of claim 2, wherein said inlet port comprises a hand-operable-type valve.

8. The lounge chair of claim 1, wherein said fluid channel comprises a piping network made of metal.

9. The lounge chair of claim 1, wherein said fluid channel is adapted to withstand a fluid pressure sufficient to cause misting at said outlet port.

10. An outdoor lounge chair which comprises:

a structure having a peripheral edge and being shaped and dimensioned to support an adult person in a reclining position above a surface, said structure comprising an envelope made of a top ply and a bottom ply of sheet plastic joined along said peripheral edge and defining therebetween a shallow chamber;

a fluid channel within said chamber, said channel including an inlet port, and at least one outlet port;

said inlet and outlet ports protruding through holes in said envelope;

means for coupling said inlet port to a source of pressurized fluid;

at least one spray nozzle mounted on said outlet port; and wherein said fluid channel comprises a piping network made of metal; and said bottom ply comprises intersecting longitudinal and transversal reinforcing ribs defining internal furrows and external ridges.

11. The lounge chair of claim 10, wherein said piping network is nested within said furrows.

12. An outdoor lounge chair which comprises:

a structure having a peripheral edge and being shaped and dimensioned to support an adult person in a reclining position above a surface, said structure comprising an envelope made of a top ply and a bottom ply of sheet plastic joined along said peripheral edge and defining therebetween a shallow chamber;

a fluid channel within said chamber, said channel including an inlet port, and at least one outlet port;

said inlet and outlet ports protruding through holes in said envelope;

means for coupling said inlet port to a source of pressurized fluid;

at least one spray nozzle mounted on said outlet port;

wherein said fluid channel comprises a piping network made of metal;

said top ply comprises at least one depressed outer area forming a well proximate the periphery of said top ply; and said nozzle is nested within said well.

13. The lounge chair of claim 12, which comprises two of said outlet ports nested in wells located in opposite marginal portions of said top ply.

14. The lounge chair of claim 13, wherein said inlet port further comprises a hand-controllable valve to adjust the flow of pressurized fluid into said piping network.

15. An outdoor lounge chair which comprises:

a structure having a peripheral edge and being shaped and dimensioned to support an adult person in a reclining position above a surface, said structure comprising an envelope made of a top ply and a bottom ply of sheet plastic joined along said peripheral edge and defining therebetween a shallow chamber;

a fluid channel within said chamber, said channel including an inlet port, and at least one outlet port;

said inlet and outlet ports protruding through holes in said envelope;

means for coupling said inlet port to a source of pressurized fluid; and at least one spray nozzle mounted on said outlet port;

wherein said top ply comprises at least one depressed outer area forming a well proximate the periphery of said top ply; and said nozzle is nested within said well.

16. The lounge chair of claim 15, wherein said fluid channel comprises a piping network made of metal.

17. The lounge chair of claim 16, wherein said structure is manufactured by a rotational molding process which comprises:

forming a two-part mold having internal surfaces defining the external surfaces of said chair;

installing said piping network into said two-part mold;

depositing into said mold a volume of thermal-plastic material;

closing said mold;

exposing said mold to a temperature high enough to melt the thermo-plastic material without affecting said piping network;

rotating said mold about two perpendicular axes at speeds and for periods sufficient to centrifugally spread said melted plastic to a substantially even thickness against said internal surface of the mold;

cooling said mold to a temperature and for a period sufficient to cure said material to a hardened state; and opening said mold to retrieve said structure.

18. The lounge chair of claim 16, wherein said inlet port comprises:

a swiveling connector;

a first coupling compatible with a mating second coupling associated with a conduit of pressurized fluid.

19. The lounge chair of claim 16, wherein said structure is buoyant enough to support said adult person over a water surface.

20. The lounge chair of claim 16, wherein said inlet port comprises a hand-operable-type valve.

* * * * *